US008038251B2

(12) United States Patent
Inaba

(10) Patent No.: US 8,038,251 B2
(45) Date of Patent: Oct. 18, 2011

(54) INK JET PRINTING METHOD AND INK JET PRINTING APPARATUS

(75) Inventor: Moriyoshi Inaba, Tokyo (JP)

(73) Assignee: Canon Finetech Inc., Joso-shi (JP)

( * ) Notice: Subject to any disclaimer, the term of this patent is extended or adjusted under 35 U.S.C. 154(b) by 364 days.

(21) Appl. No.: 12/040,174

(22) Filed: Feb. 29, 2008

(65) Prior Publication Data

US 2008/0218551 A1 Sep. 11, 2008

(30) Foreign Application Priority Data

Mar. 5, 2007 (JP) ..... 2007-053857

(51) Int. Cl.
*B41J 29/393* (2006.01)

(52) U.S. Cl. ..... 347/19; 347/29

(58) Field of Classification Search ..... 347/22, 347/32, 33, 19, 29, 30, 35, 14
See application file for complete search history.

(56) References Cited

U.S. PATENT DOCUMENTS

| | | | | |
|---|---|---|---|---|
| 6,398,336 | B1 | 6/2002 | Yoda et al. | 347/23 |
| 2005/0190226 | A1 | 9/2005 | Yoshikawa et al. | 347/23 |

FOREIGN PATENT DOCUMENTS

| | | | |
|---|---|---|---|
| EP | 0 704 307 | A2 | 4/1996 |
| EP | 0 879 701 | A2 | 11/1998 |
| JP | 62-182029 | | 8/1987 |
| JP | 08-132648 | | 5/1996 |
| JP | 08-156241 | | 6/1996 |
| JP | 2002-229278 | | 8/2002 |
| JP | 2004-142250 | | 5/2004 |
| JP | 2004-358791 | | 12/2004 |
| JP | 2005-349841 | | 12/2005 |
| JP | 2006-082243 | | 3/2006 |
| JP | 2006-198880 | | 8/2006 |

OTHER PUBLICATIONS

Official Notice of Rejection (translation), Application No. 2007-053857, Jun. 2009.

*Primary Examiner* — Lamson D Nguyen
(74) *Attorney, Agent, or Firm* — Fitzpatrick, Cella, Harper & Scinto

(57) ABSTRACT

Time for which an ejection port surface of a print head has been exposed to the exterior since the end of the last cleaning operation is predicted and accumulated as an accumulated exposure time. A cleaning timing is set to be a timing when the accumulated exposure time coincides with a set time set according to the ambient temperature and humidity of an area in which a label printer is installed. In principle, a cleaning operation is performed at the cleaning timing. However, when the cleaning timing comes during the current consecutive printing operation, the cleaning operation is not performed during the current consecutive printing operation but at a time before the start of the current consecutive printing operation or a time after the end of the current consecutive printing operation.

3 Claims, 8 Drawing Sheets

| HUMIDITY / TEMPERATURE | ~ 25% | 25 ~ 50% | 50 ~ 75% | 75% ~ |
|---|---|---|---|---|
| ~ 5°C | 20sec | 30sec | 50sec | 100sec |
| 5 ~ 15°C | 30sec | 40sec | 70sec | 130sec |
| 15 ~ 25°C | 50sec | 70sec | 100sec | 160sec |
| 25°C ~ | 80sec | 110sec | 140sec | 200sec |

FIG.7

INK JET PRINTING METHOD AND INK JET PRINTING APPARATUS

BACKGROUND OF THE INVENTION

1. Field of the Invention

The present invention relates to an ink jet printing method and an ink jet printing apparatus which print an image on a print medium while performing a cleaning operation for removing a substance (thickened ink or dirt) hindering ejection of ink, at a preset timing.

2. Description of the Related Art

Printing apparatuses (ink jet printing apparatuses) are widely used which print images by ejecting ink to print media such as print sheets. To eject ink, the ink jet printing apparatus uses a print head having a plurality of nozzles and ink ejection ports (outlets of the nozzles) formed therein. The plurality of ink ejection ports (hereinafter referred to as "ejection ports") are formed on an almost flat ejection port forming surface (hereinafter referred to as an "ejection port surface") of the print head. Two types of print heads are available; one of these types of print head ejects ink while moving in a main scanning direction together with a carriage, and the other type of print head (line head type) ejects ink while fixed and stopped. The former type of print head is used for ink jet printing apparatus based on what is called a serial scan scheme. The other type of print head is used for what is called full line type ink jet printing apparatuses.

With these printing apparatus, if thickened ink or dirt (the substance hindering ink ejection) is collected around the nozzles or ejection ports in the print head during an image printing operation or standby (non-printing operation), the ink may be inappropriately ejected or printed images may be degraded. As a technique for solving this problem, a cleaning technique is known such as pressurization recovery, wiping, or preliminary ejection (idle ejection). The pressurization recovery is a process of pressurizing the interior of the print head to push the thickened ink, bubbles, dirt, or the like out of the nozzles. The wiping is a process of wiping the ejection port surface using a cleaning blade (cleaning member) made up of an elastic body. The preliminary ejection (idle ejection) is a process of ejecting ink from the print head in order to remove the thickened ink or dirt instead of printing images.

For the cleaning operation, the image printing operation must be temporarily suspended. Japanese Patent Laid-Open No. 2005-349841 describes a technique of performing a cleaning operation during the non-printing operation to reduce delay resulting from the cleaning operation. Furthermore, Japanese Patent Laid-Open No. 2004-358791 describes a technique of periodically performing the cleaning operation on the basis of instructions from a host computer to reduce the time for which the printing operation is suspended owing to the cleaning operation.

However, with a large printing volume (the amount of printing during a consecutive printing operation of consecutively printing images), even though the cleaning operation is performed before the consecutive printing operation, the cleaning operation may need to be performed again during the consecutive printing operation. In this case, the above-described conventional techniques cannot reduce the suspension time for the printing operation. That is, the cleaning operation is performed during the consecutive printing operation. The cleaning operation is started at the timing (cleaning timing) when a predetermined condition is met. The condition is often set on the basis of the total amount of ink ejected from the print head, a change in the condition of the print head, or the like. Therefore, the printing apparatus automatically starts the cleaning operation when the condition is met. Thus, the printing operation is suspended at a user's unintended timing, and the cleaning operation is started.

An ink jet printing apparatus (commonly called a label printer) is known which consecutively prints images on a plurality of labels temporarily attached to a band-like card board so as to be arranged in a longitudinal direction. The label printer may be used to print images on the labels in synchronism with an external instrument. A label attaching operation may be performed during a post-process after the printing operation of the label printer has been completed. Thus, if the printing operation is suspended at the user's unintended timing as described above, the label printer may fail to synchronize with the external instrument or the post-process operation may be complicated.

Furthermore, one type of label printer has a function of allowing the user to pre-instruct the printer on a unit for batch printing (the unit for consecutive printing of images on a plurality of labels) (see, for example, Japanese Patent Laid-Open No. 62-182029 (1987)). This type of label printer is effective in printing images of the same content on a plurality of labels. If the labels have different print contents, when the printing operation is suspended at the user's unintended timing as described above and instead the cleaning operation is performed, the above-described problems, that is, the failure to synchronize with the external instrument and the complicated post-process operation, become more serious.

Furthermore, a full line type ink jet printing apparatus having a plurality of the line head type print heads arranged in a print medium conveying direction has a long distance between a print head located on the most upstream side of the print medium conveying direction and a print head located on the most downstream side of the print medium conveying direction. Thus, for example, a print medium positioned below the print head on the conveying direction most upstream side may be different from a print medium positioned below the print head on the conveying direction most downstream side (the succeeding print medium and the preceding print medium). To suspend the printing operation for the cleaning operation, it is necessary to complete printing the print medium on which the image is being printed (preceding print medium), then discharge the preceding print medium, and move the succeeding print medium to a downstream position in the conveying direction where the succeeding print medium does not hinder the cleaning operation, before performing the cleaning operation. Consequently, when the printing operation is restarted after the cleaning operation has been completed, the print medium on which the corresponding image has not been completely printed yet is moved to the position where image printing is possible. This requires a process of conveying the succeeding print medium in a direction opposite to the conveying direction (back feed). This may in turn further degrade productivity, prevent the printing apparatus from synchronizing with the external instrument, or complicate the post-process operation.

SUMMARY OF THE INVENTION

The present invention provides an ink jet printing method and an ink jet printing apparatus which prevent a consecutive printing operation of consecutively printing images from being suspended by a cleaning operation.

In the first aspect of the present invention, there is provided an ink jet printing method of using a print head capable of ejecting ink through an ejection port formed on an ejection port surface to form an image on a print medium and performing a cleaning operation for removing a substance hindering ejection of the ink, at a preset cleaning timing, wherein when the cleaning timing comes during a consecutive printing operation of consecutively printing images, the cleaning operation is not performed during the consecutive printing operation but before start of the consecutive printing operation or after end of the consecutive printing operation.

In the second aspect of the present invention, there is an ink jet printing apparatus using a print head capable of ejecting ink through an ejection port formed on an ejection port surface to form an image on a print medium, the ink jet printing apparatus having cleaning means capable of performing a cleaning operation for removing a substance hindering ejection of the ink, at a preset cleaning timing, the apparatus comprising: cleaning timing storage means for storing the cleaning timing; instructing means for instructing the cleaning means to perform the cleaning operation when the cleaning timing comes; first storage means for storing an accumulated dot count that is an accumulated number obtained by predicting and accumulating number of times that the print head ejects ink between end of the last cleaning operation and end of the current consecutive printing operation; first determining means for determining whether or not the cleaning timing set on the basis of the accumulated dot count comes during the current consecutive printing operation; and control means for, when the first determining means determines that the cleaning timing comes during the current consecutive printing operation, controlling the instructing unit so that the cleaning operation is not performed during the current consecutive printing operation but before start of the current consecutive printing operation or after end of the current consecutive printing operation.

According to the present invention, the cleaning operation is not performed during the consecutive printing operation of consecutively printing images but before the start of the consecutive printing operation or after the end of the consecutive printing operation. This prevents the consecutive printing operation from being suspended. This in turn makes it possible to avoid failing to synchronize with an external instrument or complicating a post-process operation, improving productivity (printing efficiency). Furthermore, by performing the cleaning operation before the start of the consecutive printing operation, it is possible to maintain the high quality of printed images obtained by the consecutive printing operation.

Further features of the present invention will become apparent from the following description of exemplary embodiments (with reference to the attached drawings).

BRIEF DESCRIPTION OF THE DRAWINGS

FIG. 7 is a diagram illustrating a set time varied depending on temperature and humidity.

DESCRIPTION OF THE EMBODIMENTS

An embodiment of the present invention will be described below with reference to the drawings. An ink jet printing apparatus in the embodiment described below is an example in which the present invention is applied to a label printer capable of consecutively printing images on a plurality of labels temporarily attached to a band-like card board so as to be arranged in a longitudinal direction (consecutive printing operation).

Figure 1:
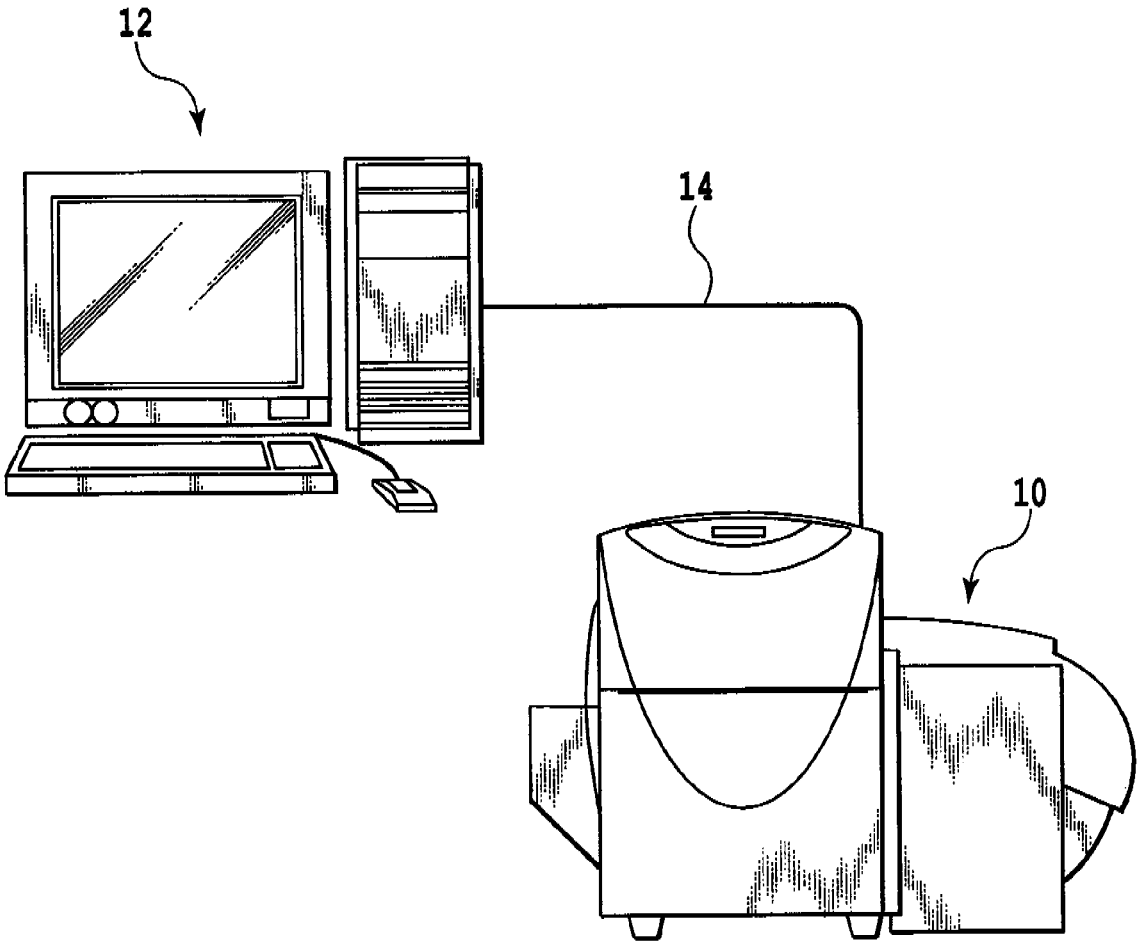
FIG. 1 is a diagram illustrating a system configuration in which a host computer is connected to a label printer as an example of the present invention.
Figure 2:
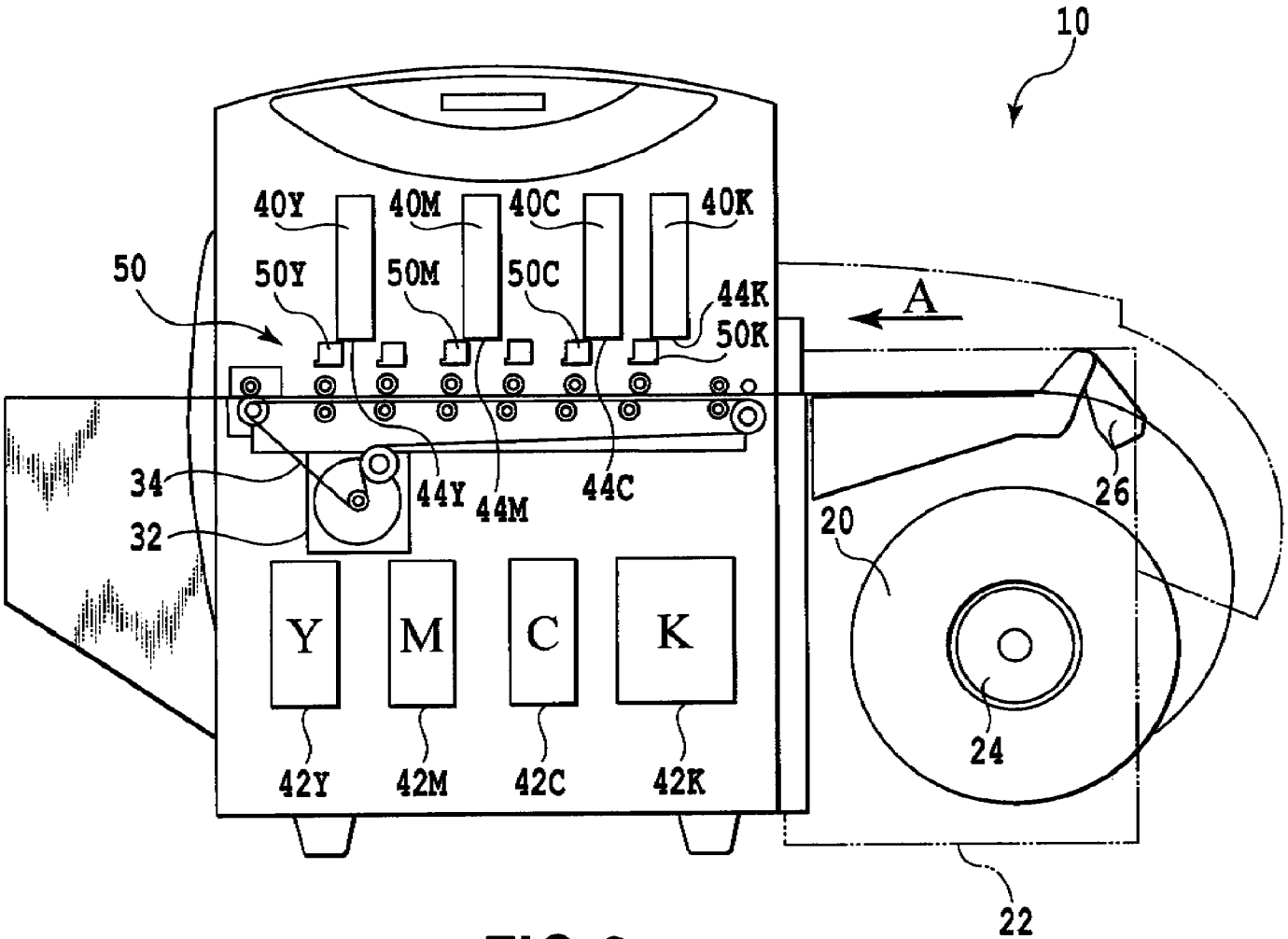
FIG. 2 is a front view schematically showing the general configuration of the label printer in FIG. 1.

With reference to FIGS. 1 and 2, description will be given of the general configuration of the label printer as an example of the present invention.

FIG. 1 is a diagram illustrating a system configuration in which a host computer is connected to the label printer as an example of the present invention. FIG. 2 is a front view schematically showing the general configuration of the label printer in FIG. 1.

A label printer 10 is connected, by a cable 14, to a host computer (host apparatus) as an information processing apparatus. The host computer 12 outputs image data, sheet size information, consecutively printed sheet count information (information indicating the number of labels on which images are consecutively printed), and the like to the label printer 10 via the cable 14 as control commands. The host computer 12 receives status information (variation information such as error information) on the label printer 10 as a control command to notify the user of the status of the label printer 10.

Reference numeral 20 denotes a continuous label sheet (an example of a print medium) composed of a band-like card board to which a plurality of labels are temporarily attached along a longitudinal direction of the card board. The label printer 10 can consecutively print images on the plurality of labels temporarily attached to the continuous label sheet 20 (a consecutive printing operation). The number of labels on which the images are consecutively printed can be appropriately set by the user. The continuous label sheet 20 is installed in a roll unit 22. The continuous label sheet 20 is supplied to a conveying section comprising a conveying motor 32 and a conveying belt 34 and then conveyed in the direction of arrow A.

The label printer 10 has a print head 40K for ejecting black (K) ink, a print head 40C for ejecting cyan (C) ink, a print head 40M for ejecting magenta (M) ink, and a print head 40Y for ejecting yellow (Y) ink. The print heads 40K, 40C, 40M, and 40Y are full line type print heads each having a nozzle row of a length corresponding to the width of the labels temporarily attached to the continuous label sheet 20. The nozzle row is a row in which a plurality of nozzles capable of ejecting the ink are arranged. The nozzles eject ink through ejection ports formed on substantially flat ejection port surfaces 44K, 44C, 44M, and 44Y of the print heads. Electrothermal transducers (heaters), piezo elements, or the like may be used as ejection energy generating elements that eject the ink. The electrothermal transducers can bubble ink in the nozzles and utilize the resulting bubbling energy to eject the ink through the ejection ports. The four print heads 40K, 40C, 40M, and 40Y eject the black ink, cyan ink, magenta ink, and yellow ink, respectively, to allow full color images to be printed on the labels. The label printer 10 consecutively prints images on the labels the number of which is specified by the host computer 12.

The inks ejected from the print heads 40K, 40C, 40M, and 40Y are fed from ink cartridges 42K, 42C, 42M, and 42Y corresponding to the respective ink colors, by means of a pump (not shown).

The roll unit 22 comprises a roll driving shaft 24 around which the continuous label sheet 20 is installed, a roll sensor lever 26 the position of which is varied by the slack of the continuous label sheet 20, and a sheet feeding motor 79 (see FIG. 3) that drives the roll driving shaft 24. The continuous label sheet 20 is stably fed by controllably driving and stopping the sheet feeding motor 79 (see FIG. 3) depending on the position of the roll sensor lever 26.

The label printer 10 comprises a cleaning unit 50 that removes thickened ink or dirt from the ejection port surfaces 44K, 44C, 44M, and 44Y of the print heads 40K, 40C, 40M, and 40Y. The cleaning unit 50 comprises a wipe blade that wipes the ejection port surfaces 44K, 44C, 44M, and 44Y to wipe off the thickened ink or dirt attached to the ejection port surfaces 44K, 44C, 44M, and 44Y, and a tub that receives the inks ejected from the print heads 40K, 40C, 40M, and 40Y by a preliminary ejection operation. Four cleaning units 50K, 50C, 50M, and 50Y are arranged in association with the print heads 40K, 40C, 40M, and 40Y. Moreover, two extra cleaning units are provided. The cleaning units 50K, 50C, 50M, 50Y, and the like (hereinafter also collectively referred to as the "cleaning unit 50") have the positions thereof controlled by a cleaning unit control motor 74 (see FIG. 3) to perform a print head cleaning operation and a capping operation as described below.

An electrical system in the label printer 10 will be described with reference to FIG. 3.

Figure 3:
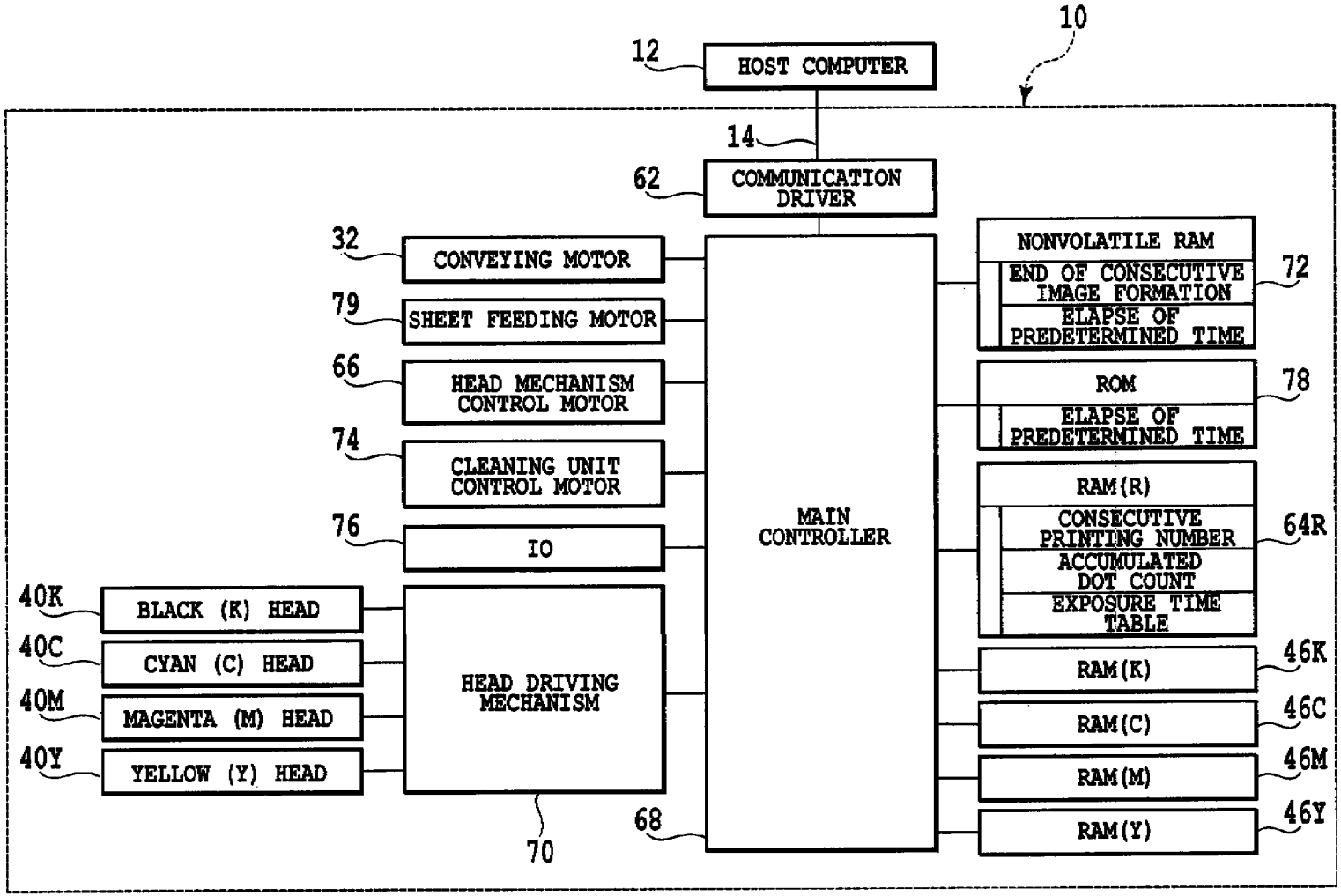
FIG. 3 is a block diagram showing an electrical system in the label printer in FIG. 2.

FIG. 3 is a block diagram showing the electrical system in the label printer in FIG. 2.

The host computer 12 transfers image data for printing or the like to the label printer 10 as a control command to instruct the label printer 10 to start a printing process. The host computer 12 can send a sheet setting command that specifies the number of labels to be printed by the label printer 10, the type and size of the continuous label sheet 20, and the like, a command that specifies a print speed, and a command for the consecutively printed sheet count information (information indicating the number of labels on which images are consecutively printed).

The label printer 10 uses a communication driver 62 to control communications to receive the commands (the data command, the sheet setting command, and the like) from the host computer 12. The image data received by the label printer 10 is expanded and drawn on RAMs 46K, 46C, 46M, and 46Y in bit map form as the image data for respective color components. On the RAMs 46K, 46C, 46M, and 46Y, the image data for the color components corresponding to the black (K), cyan (C), magenta (M), and yellow (Y) inks are expanded in bit map form. Furthermore, the sheet setting command specifying the number and size of labels and the number of labels to be printed is stored in the RAM 64R. The data command and the sheet setting command, and the like are expanded on the RAMs 46K, 46C, 46M, and 46Y, the print heads 40K, 40C, 40M, and 40Y are moved to a print position by a head mechanism control motor 66.

To print images on a plurality of labels, a main controller 68 sequentially reads, from the RAMs 46K to 46Y, the corresponding color image data in synchronism with the conveyance of the continuous label sheet 20. The image data is output, via a head driving circuit 70, to the print heads 40K to 40Y, which eject the corresponding color inks. The print heads 40K to 40Y eject the corresponding color inks on the basis of the input image data to print multicolor images on the labels. The main controller 68 acts as cleaning instructing means, first determining means, second determining means, and control means according to the present invention. As described below, the instructing means instructs the printer to perform the cleaning operation. The first determining means determines whether or not a cleaning timing set on the basis of an accumulated dot count is reached during the consecutive printing operation. The second determining means determines whether or not a cleaning timing set on the basis of an exposure accumulated time is reached during the consecutive printing operation. The control means controls the instructing means on the basis of the determination of the first and/or second determining means.

When image printing based on a plurality of image data is completed or a predetermined time has elapsed, that timing (time) is stored in a nonvolatile RAM 72. The number of times that the ink is ejected from the print heads 40K to 40Y as droplets is accumulated for each of the print heads 40K to 40Y and stored in the RAM 64R. Since the ink ejected as droplets forms ink dots on the label, the number of times that the print heads 40K to 40Y ejects the ink corresponds to the number of dots formed. The number of times that the print heads 40K to 40Y ejects the ink is hereinafter referred to as the dot count. The accumulated dot count for each of the print heads 40K to 40Y is hereinafter referred to as the accumulated dot count. As described below, it is possible to predict, on the basis of the image data, the accumulated dot count for each of the print heads 40K to 40Y between the end of the last cleaning operation and the end of the current consecutive printing operation. The predicted accumulated dot count is stored in the RAM 64R. Thus, the RAM 64R is an example of storage means for the accumulated dot count according to the present invention (first storage means). When the cleaning operation is started, the stored accumulated dot count is cleared to zero. When the cleaning operation is completed, the counting is restarted.

The following time is also accumulated as an accumulated exposure time: the time for which the print heads 40K to 40Y are located at positions where the print heads 40K to 40Y are not capped by the tub of the cleaning unit 50, that is, the exposure time for which the ejection port surfaces of the print heads 40K to 40Y are exposed to the air. In this case, the exposure time from the end of the last cleaning operation until the end of the current consecutive printing operation is accumulated as the accumulated exposure time. The exposure time can be predicted on the basis of data required to perform the current continuous printing operation as described below. The RAM 64R also stores the accumulated exposure time. Consequently, the RAM 64R has a function of storing the accumulated exposure time (second storage means) according to the present invention. When the cleaning operation is started, the stored accumulated exposure time is cleared to zero. When the cleaning operation is completed, the counting is restarted.

To perform the cleaning operation, the cleaning unit control motor 74 moves the cleaning unit 50 (see FIG. 2) and allows the wipe blade to wipe the ejection port surfaces of the print heads. To perform, as the cleaning operation, the preliminary ejection operation for ejecting ink not contributing to image printing (idle ejection), from the print head, the cleaning unit control motor 74 moves the cleaning unit 50 so that the tub of the cleaning unit 50 can receive the ink ejected by the preliminary ejection operation. Furthermore, the following data is input to the main controller 68 via an IO port 76: measurement data from a temperature sensor and a humidity sensor (neither of the sensors are shown) which measure the ambient temperature and ambient humidity of the print heads 40K to 40Y, and detection data from a position detecting sensor and the like provided in mechanical sections of the label printer. The above-described control in the label printer is performed by the main controller 68 by executing control programs stored in a ROM 78. The ROM 78 is an example of cleaning timing storage means according to the present invention and stores an exposure time table shown in FIG. 7 described below.

The continuous label sheet 20 will be described with reference to FIG. 4.

Figure 4:
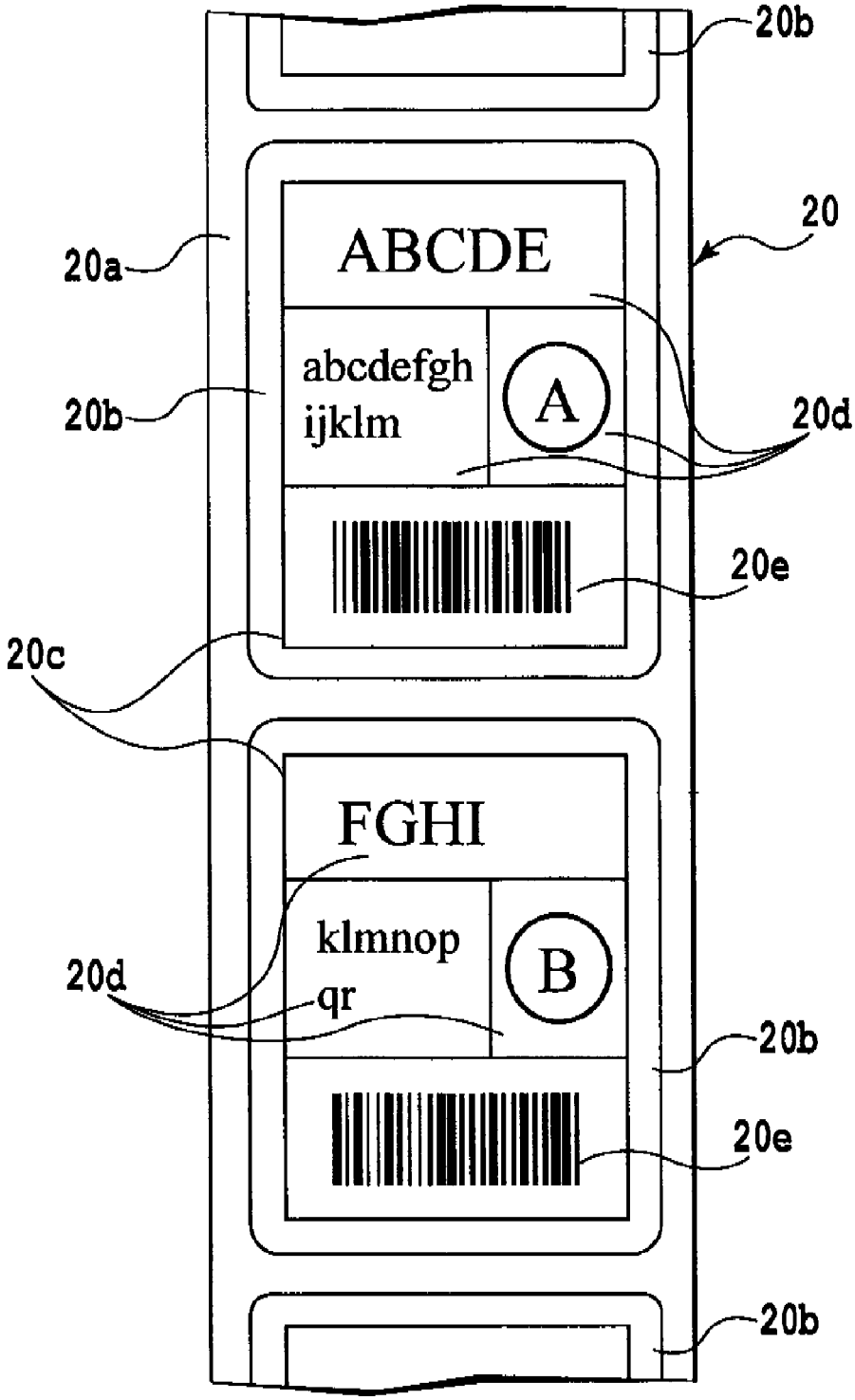
FIG. 4 is a plan view showing a part of continuous label paper.

FIG. 4 is a plan view showing a part of the continuous label sheet.

The continuous label sheet 20 is elongate and is wound, like a roll, around a cylindrical core having a hollow portion. A plurality of piece-like labels 20*b* each with a printable surface are tacked to a card board 20*a* for the continuous label sheet 20 at equal intervals. The label printer 10 can consecutively print different images on the respective labels 20*b* at a high speed (consecutive printing operation) by superimposing, on the plurality of labels, common form data and field data varying with the label. In the present example, the form data is data for frame lines 20*c*, and the field data is data for character strings 20*d* and a barcode 20*e*.

Figure 5:
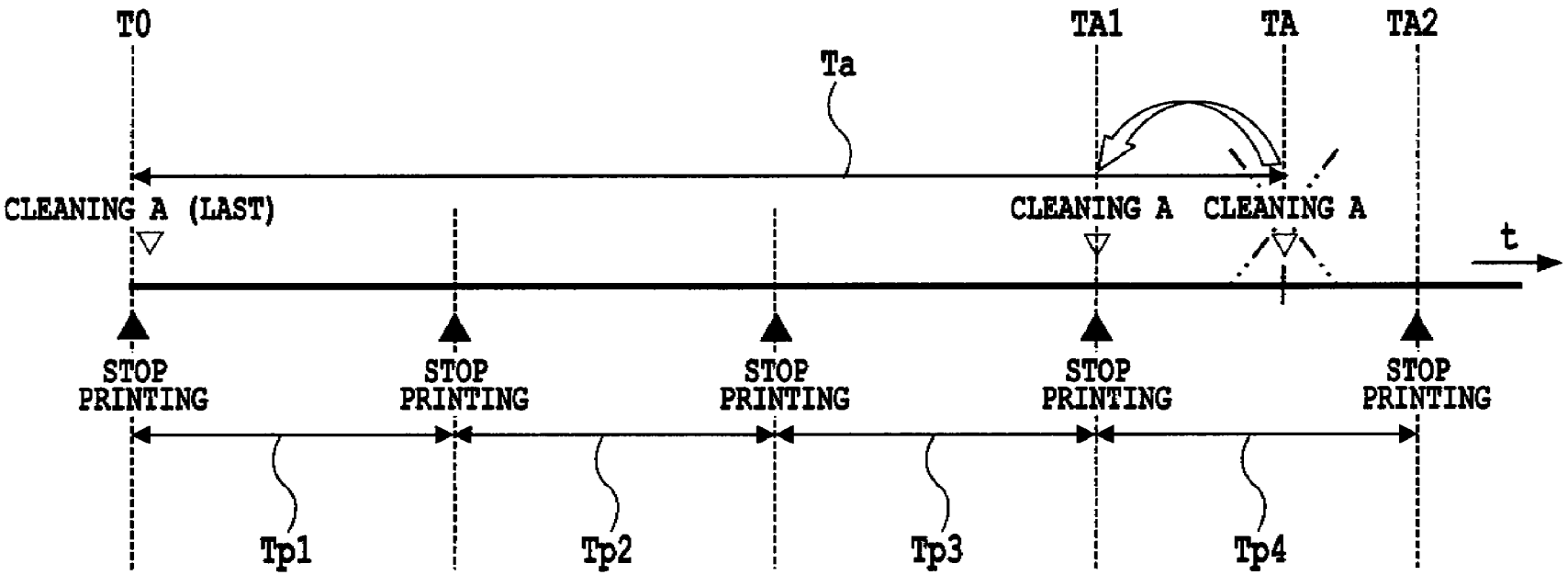
FIG. 5 is a diagram illustrating an example of cleaning timings set on the basis of an environment in which the label printer is used.
Figure 6:
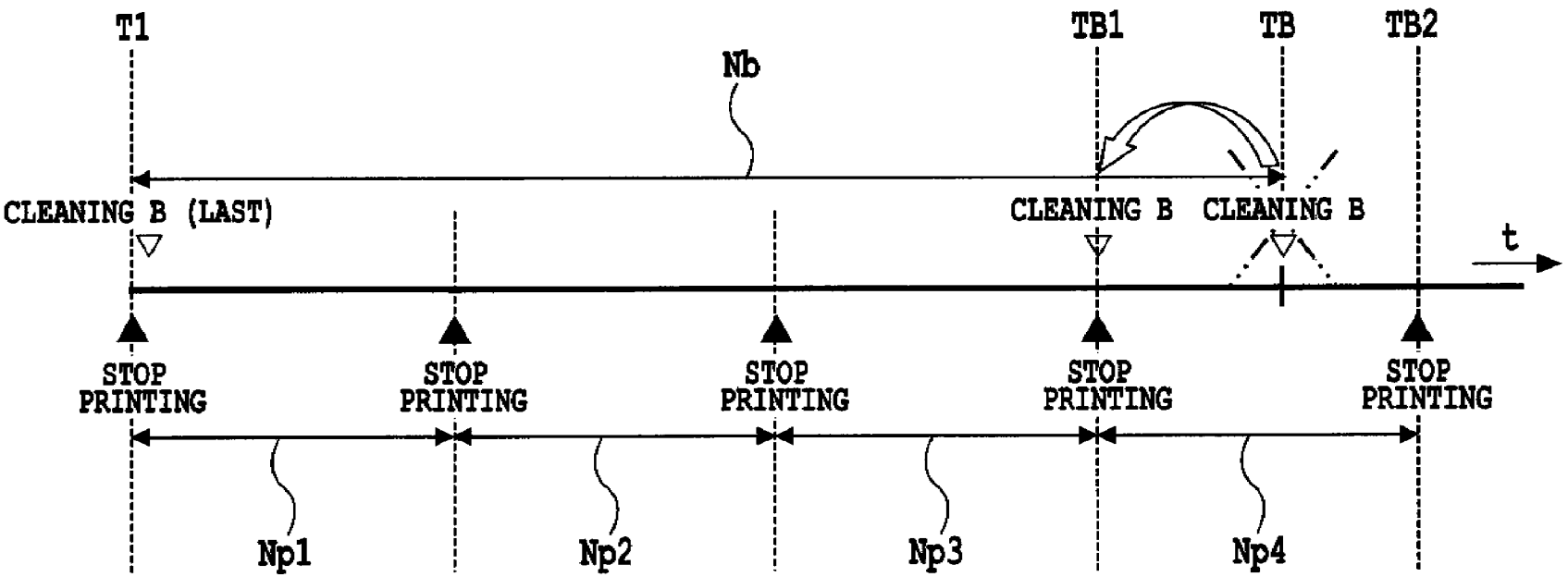
FIG. 6 is a diagram illustrating an example of cleaning timings set on the basis of the number of times (ejection dot count) that ink droplets are ejected from a print head.

With reference to FIGS. 5, 6, and 7, description will be given of a cleaning timing for performing the cleaning operation and how to change the cleaning timing. The cleaning operation removes a substance hindering ink ejection (thickened ink or dirt), from the print heads 40K to 40Y. Examples of the cleaning operation include the wiping and preliminary ejection, described above and pressurization recovery, described below. A cleaning timing is preset as timing for performing the cleaning operation.

FIG. 5 is a diagram illustrating an example of cleaning timings set on the basis of an environment in which the label printer is used. FIG. 6 is a diagram illustrating an example of cleaning timings set on the basis of the number of times that the ink has been ejected from the print heads 40K to 40Y (dot count). FIG. 7 is a diagram illustrating a set time Ta set on the basis of temperature and humidity.

Two conditions for regularly performing the cleaning operation are set for the label printer 10. The contents (type) of the cleaning operation performed vary between the two conditions.

The first condition specifies that the accumulated time for which the ejection port surfaces of the print heads remain uncapped (accumulated exposure time) reach a preset value (set time) Ta. In principle, when the accumulated exposure time reaches the set value Ta, the cleaning operation is performed. However, the cleaning operation may not be performed as described below. The cleaning operation performed in this case is the preliminary ejection. This cleaning operation is hereinafter referred to as cleaning A for convenience. Even if no ink has been ejected through one of the nozzles until the set time Ta, the preliminary ejection ejects thickened ink present near the ejection port surface for that nozzle, that is, the ink with increased viscosity owing to the evaporation of moisture to the air. The appropriate ink ejection condition can thus be maintained.

The second condition specifies that the accumulated number of times that the ink has been ejected from the print head (accumulated dot count) reach a preset dot count (set count) Nb. In principle, when the accumulated dot count reaches the set count Nb, the cleaning operation is performed. However, the cleaning operation may not be performed as described below. The cleaning operation in this case is such that the pressurization recovery, the wiping, and the preliminary ejection are performed in this order. This cleaning operation is hereinafter referred to as cleaning B for convenience. The pressurization recovery is a process of pressurizing the ink in the print head to forcibly discharge the ink into the tub of the cleaning unit 50 through the nozzle. The cleaning B is a cleaning operation more powerful than the cleaning A. That is, since the thickened ink and dirt are pushed out and wiped off by the pressurization recovery operation and the wiping operation and the preliminary ejection operation is further performed, a strong recovery force can be exerted.

First, with reference to FIGS. 5 and 7, description will be given of a cleaning timing for performing the cleaning A.

As shown in FIG. 7, the set time Ta is varied depending on the ambient temperature and humidity of the area in which the label printer 10 is installed (the ambient temperature and humidity of this area are the same as those of the print head). For example, when the temperature is at most 5° C. and the humidity exceeds 75%, the set time Ta is 100 seconds. When the temperature exceeds 25° C. and the humidity is at most 25%, the set time Ta is 80 seconds. When the accumulated exposure time reaches the set time Ta, the first condition is met and the cleaning A is in principle performed. The table shown in FIG. 7 is stored in the ROM 78. The temperature and humidity are measured by the above-described temperature sensor and humidity sensor (neither of the sensors are shown) and input to the main controller 68 via the IO port 76. The main controller 68 reads the table shown in FIG. 7 from the ROM 78 to select the set time Ta.

The label printer 10 prints images on every consecutive printing number of labels; the consecutive printing number is specified by the host computer 12 (see FIG. 3). The consecutive printing number refers to the number of labels on which images are consecutively printed (consecutive printing). Reference numerals Tp1, Tp2, Tp3, and Tp4 denote the time required for the first, second, third, and fourth consecutive printing operations, respectively. While the images are being printed on the labels, the print heads 40K to 40Y are at print positions. Thus, during the consecutive printing operation, the time for which the print heads 40K to 40Y have been exposed to the air since a time T0 when the last cleaning A was complete is sequentially accumulated. For example, when the amounts of time Tp1, Tp2, Tp3, and Tp4 required for the respective consecutive printing operations are the same, that is, the amount of time Tp, the exposure time from the time T0 when the last cleaning A is completed is accumulated every amount of time Tp. As described below, the exposure time can be predicted on the basis of data required to perform the consecutive printing operation. Even during the consecutive printing operation, the exposure time is accumulated according to the progress of the operation. When the first consecutive printing operation (the duration of the first consecutive printing operation is Tp2) is completed after the last cleaning A, the accumulated exposure time is Tp1. Subsequently, when the second consecutive printing operation (the duration of the consecutive printing operation is Tp2) is completed, the accumulated exposure time is Tp1+Tp2. Subsequently, when the third consecutive printing operation (the duration of the third consecutive printing operation is Tp3) is completed, the accumulated exposure time is Tp1+Tp2+Tp3.

When the third consecutive printing operation is completed, the fourth consecutive printing operation (the duration of the fourth consecutive printing operation is Tp4) is performed. In the present example, the accumulated exposure time reaches the set time Ta during the fourth consecutive printing operation. A timing TA when the accumulated exposure time coincides with the set time Ta corresponds to the cleaning timing. In principle, the cleaning A is performed at the timing TA. However, if the cleaning A is performed during the fourth consecutive printing operation, the printing operation is suspended. Thus, in the present example, when the timing TA is expected to be coming when the accumulated exposure time coincides with the set time Ta, the cleaning A is not performed at the timing TA but at a time TA1 before the start of the fourth consecutive printing operation or at a time TA2 after the end of the fourth consecutive printing operation. As a result, the cleaning operation is not performed during the consecutive printing operation specified by the host computer 12. This eliminates the need to suspend the printing operation or to feed the continuous label sheet backward.

Now, the second condition described above will be described.

The second condition specifies that the accumulated number of times that the ink has been ejected from the print head (accumulated dot count) reach the set count Nb as described above. When this condition is met, the cleaning B is in principle performed. However, the cleaning B may not be performed as described below.

The set count Nb is present in accordance with the characteristics of the print heads 40K to 40Y. As described above, the label printer 10 prints images on every consecutive printing number of labels; the consecutive printing number is specified by the host computer 12 (see FIG. 3).

Reference numerals NP1, Np2, Np3, and Np4 in FIG. 6 each denote the accumulated number of times (accumulated dot counts) that the ink has been ejected from one of the print heads during the first, second, third, and fourth consecutive printing operations, respectively. Np1, Np2, . . . are sequentially added to the accumulated dot count every time one consecutive printing operation is completed after a time T1 when the last cleaning B is completed. The accumulated dot count can be predicted on the basis of image data (one of the data required to perform the consecutive printing operation). Thus, even during the consecutive printing operation, the dot count is accumulated according to the progress of the operation. When the first consecutive printing operation (the ink ejection count during the first consecutive printing operation is Np1) is completed after the last cleaning B, the accumulated dot count is Np1. When the second consecutive printing operation (the ink ejection count during the second consecutive printing operation is Np2) is completed, the accumulated dot count is Np1+NP2. Subsequently, when the third consecutive printing operation (the ink ejection count during the third consecutive printing operation is Np3) is completed, the accumulated dot count is Np1+NP2+Np3.

When the third consecutive printing operation is completed, the fourth consecutive printing operation (the ink ejection count during the fourth consecutive printing operation is Np4) is performed. In the present example, the accumulated dot count reaches the set count Nb during the fourth consecutive printing operation. A timing TB when the accumulated dot count coincides with the set count Nb corresponds to the cleaning timing. In principle, the cleaning B is performed at the timing TB. However, if the cleaning B is performed during the fourth consecutive printing operation, the printing operation is suspended. Thus, in the present example, when the timing TB is predicted to be coming when the accumulated dot count coincides with the set count Nb, the cleaning B is not performed at the timing TB but at a time TB1 before the start of the fourth consecutive printing operation or at a time TB2 after the end of the fourth consecutive printing operation. As a result, the cleaning operation is not performed during the consecutive printing operation specified by the host computer 12. This eliminates the need to suspend the printing operation or to feed the continuous label sheet backward.

Since the dot count depends on image data, the dot count value during printing of a consecutive printing number of labels can be predicted on the basis of received image data. Specifically, if the specified consecutive printing number of labels is 10, the received image data corresponds to three labels, and image data on the remaining seven labels is to be received during the printing operation, the dot count value corresponding to the image data on the 10 labels is predicted on the basis of the received image data on the three labels. For example, if the dot count value corresponding to the image data on the three labels is 3,000 dots, the dot count value corresponding to the image data on the 10 labels can be predicted to be 10,000 dots. If the dot count value varies significantly with the image data, the predicted dot count value is multiplied by a coefficient. The prediction of the dot count value is performed by the main controller 68, and the result of the prediction is stored in the RAM 64R.

As described above, when the cleaning timing comes during the consecutive printing operation of consecutively forming images, the cleaning operation is not performed at that cleaning timing but before the start of or after the end of that consecutive printing operation. This prevents the consecutive printing operation from being suspended, making it possible to avoid degrading productivity (reducing printing efficiency), failing to synchronize with an external instrument, or complicating post-process operations. Furthermore, if the cleaning operation is performed before the start of the consecutive printing operation, the quality of print images can be prevented from being degraded.

Figure 8:
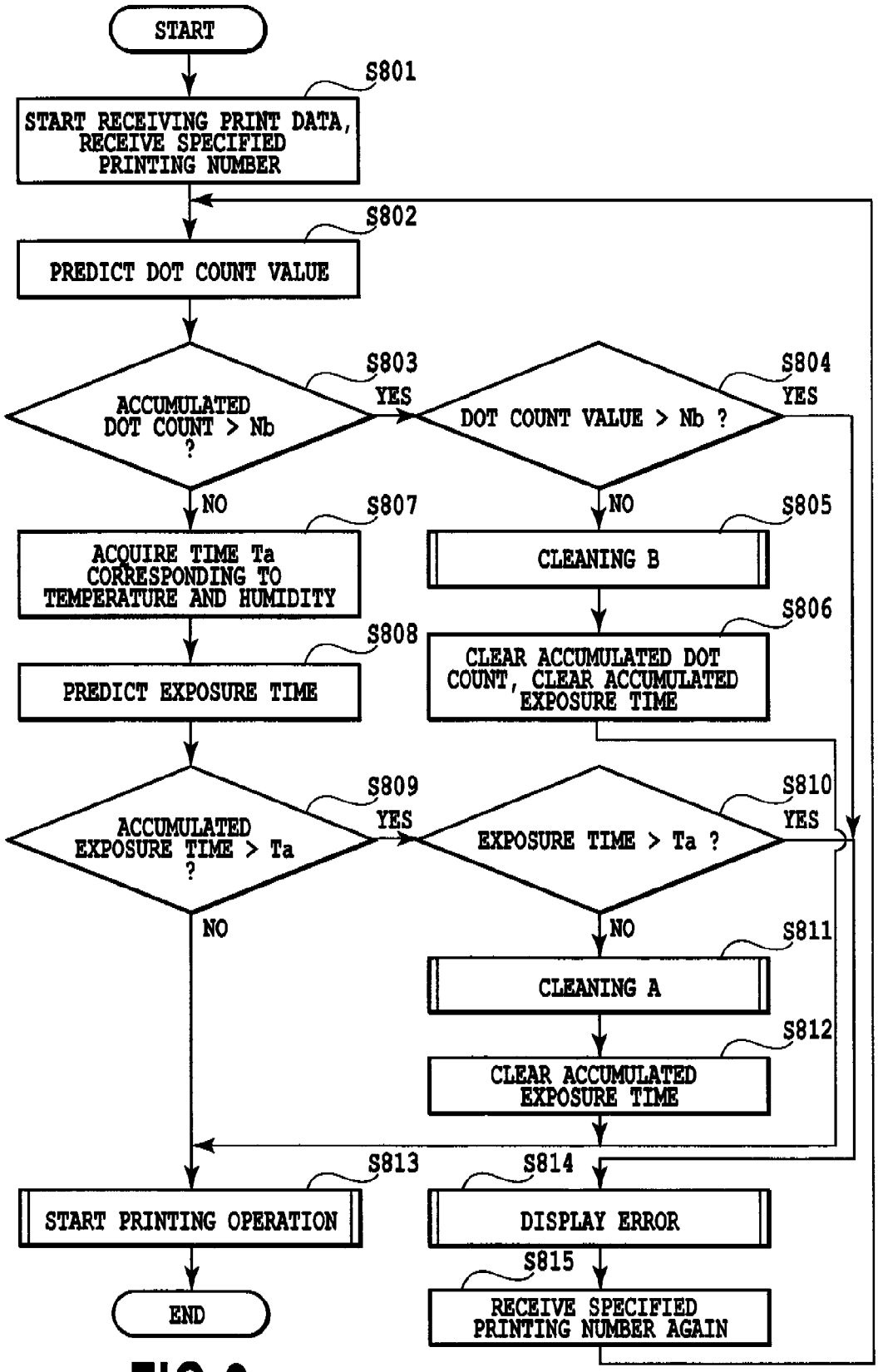
FIG. 8 is a flowchart showing an example of an ink jet based image forming method according to the present invention.

With reference to FIG. 8, an example of an ink jet printing method according to the present invention will be described.

FIG. 8 is a flowchart showing an example of the ink jet printing method according to the present invention.

This flow is started when the host computer 12 (see FIG. 3) transmits a start signal to the label printer 10 (see FIG. 3) to start the current consecutive printing operation. The host computer 12 transmits image data and command data specifying a sheet size, a printing speed, the consecutive printing number, and the like to the label printer 10, which receives the data for performing the consecutive printing (S801). The main controller 68 (see FIG. 3) executes a predicting process to predict the dot count value on the basis of the received image data. That is, the total of the dot count value is predicted which is obtained when the printing of the specified consecutive printing number of labels is completed (S802). For example, the main controller 68 predicts, as the dot count value, the total of the number of times that the ink is ejected from the print head 40K during the current consecutive printing operation. The label printer 10 continues to receive the subsequent print data.

Before the current consecutive printing operation is started, the dot count value predicted in S802 has been added to the accumulated dot count stored in the RAM 64R, and the resulting value has been stored in the RAM 64R as a new accumulated dot count. Subsequently, the main controller 68 (see FIG. 3) compares the new accumulated dot count with the set count Nb (S803). Upon determining that the accumulated dot count is greater than the set count Nb, the main controller 68 proceeds to S804. In S804, the main controller 68 compares the predicted dot count value (the ink ejection count only during the current consecutive printing operation) with the set count Nb. If the dot count value is determined to be smaller than the set count Nb, the cleaning unit control motor 74 (see FIG. 3) or the like is driven to perform the cleaning B before the current consecutive printing operation is started (S805). At this time, the cleaning timing corresponds to TB1 in FIG. 6. The cleaning B maintains the print head in the appropriate ink ejection condition. Furthermore, since the dot count value is smaller than the set count Nb, the cleaning B is not performed during the current consecutive printing operation.

After the cleaning B is performed in S805, the accumulated dot count (the count value for the cleaning B) and the accumulated exposure time (the count value for the cleaning A), described below, are cleared to zero (S806); both the accumulated dot count and the accumulated exposure time are stored in the RAM 64R. Subsequently, the current consecutive printing operation is started (S813). The reason why not only the count value for the cleaning B (accumulated dot count) but also the count value for the cleaning A (accumulated exposure time) is cleared in S806 is that the cleaning B is more powerful than the cleaning A and that performing the cleaning B more reliably improves the ink ejection condition of the print head.

When the main controller 68 determines in S804 that the predicted dot count value (the ink ejection count only during the current consecutive printing operation) is greater than the set count Nb, even if the cleaning B is performed before the start of the current consecutive printing operation, the cleaning timing TB comes again during the current consecutive printing operation to suspend the consecutive printing operation. Thus, upon determining in S804 that the predicted dot count value is greater than the set count Nb, the main controller 68 causes the label printer 10 to display an error (S814) and waits for the host computer 12 to re-specify the consecutive printing number (S815). The main controller 68 returns to the process of predicting the dot count value on the basis of the re-specified consecutive printing number (S802), and then executes the subsequent process.

Upon determining in S803 that the accumulated dot count is smaller than the set count Nb, the main controller 68 shifts to a process of checking the condition for the cleaning A (S807). In S807, on the basis of the detected values of the temperature and humidity of the vicinity of the label printer 10, the main controller 68 acquires a time Ta (stored in the ROM 78) that is the condition for the cleaning A, from the exposure time table in FIG. 7. Subsequently, the main controller 68 predicts the exposure time value of the print head expected to be measured when until the current consecutive printing operation is completed, on the basis of the printing number and printing speed specified for the current consecutive printing operation (S808). The specified printing number and printing speed are part of the data required to perform the current consecutive printing operation.

The exposure time predicted in S808 is added to the accumulated exposure time stored in the RAM 64R, before the current consecutive printing operation is started. The resulting value is stored in the RAM 64R as a new accumulated exposure time. Subsequently, the main controller 68 compares the new accumulated exposure time with the set time Ta (S809).

Upon determining in S809 that the new accumulated exposure time is longer than the set time Ta, the main controller 68 proceeds to S810. In S810, the main controller 68 compares the predicted exposure time (the exposure time only during the current consecutive printing operation) with the set time Ta. Upon determining that the exposure time is shorter than the set time Ta, the main controller 68 performs the cleaning A before the start of the current consecutive printing operation (S811). The cleaning A maintains the print head in the appropriate ink ejection condition. Furthermore, since the predicted exposure time is shorter than the set time Ta, the cleaning A is not performed during the current consecutive printing operation. After the cleaning A is performed in S811, the accumulated exposure time (the count value for the cleaning A) stored in the RAM 64R is cleared to zero (S812). Subsequently, the current consecutive printing operation is started (S813).

When the main controller 68 determines in S810 that the predicted exposure time is longer than the set time Ta, even if the cleaning A is performed before the start of the current consecutive printing operation, the cleaning timing TA comes again during the current consecutive printing operation to suspend the consecutive printing operation. Thus, upon determining that the predicted exposure time is longer than the set time Ta as described above, the main controller 68 causes the label printer 10 to display an error (S814) and waits for the host computer 12 to re-specify the consecutive printing number (S815). The main controller 68 returns to the process of predicting the dot count value on the basis of the re-specified consecutive printing number (S802).

Other Embodiments

In the above-described embodiment, the label printer 10 is connected to the host computer 12. However, the label printer 10 may be connected to an external instrument such as a labeling machine. In this case, the consecutive printing number may be specified using communication standards such as RS-232C as an I/F for the external instrument. Alternatively, the unit for a printing operation specified by the host computer 12 may be the distance of a printing range on print media or printing time instead of the number of print media.

Furthermore, the present invention is widely applicable to various ink jet printing apparatuses other than the label printer. For example, the present invention is applicable to an ink jet printing apparatus printing print media one by one and an ink jet printing apparatus printing elongate print media every predetermined distance or every predetermined amount of time. The printing apparatuses may be based on a serial scan scheme or a full line scheme. Basically, any printing apparatus may be used provided that the printing apparatus can consecutively perform the printing operation a number of times using the number of print media, the printing range, or the printing time as an operation unit, as the consecutive printing operation.

Furthermore, the cleaning operation may be any of various operations such as the wiping, preliminary ejection, and pressurization recovery, described above, as well as suction recovery. The suction recovery is an operation of introducing a negative pressure into a cap that caps the ejection ports in the print head to suck and discharge the ink not contributing to image printing, into the cap. The cleaning operation essentially has only to remove the substance hindering the ink ejection (thickened ink or dirt) from the print head.

Furthermore, the present invention may be applied to a system composed of a plurality of instruments (for example, a host computer, an interface instrument, and a printer) or to an apparatus made up of one instrument (for example, a copier or a facsimile machine). Moreover, of course, the functions of the above-described embodiment can be provided by supplying a system or an apparatus with a storage medium in which a software program code implementing the functions is stored, and allowing a computer (or a CPU or MPU) in the system or apparatus to read and execute the program code stored in the storage medium. In this case, the program code itself read from the storage medium implements the functions of the above-described embodiment. The storage medium storing the program code constitutes the present invention. The storage medium for supplying the program code may be, for example, a floppy (registered trade mark) disk, a hard disk, an optical disk, a magneto optic disk, a CD-ROM, a CD-R, a magnetic tape, a nonvolatile memory card, or a ROM.

Furthermore, the functions of the above-described embodiment may be provided not only by allowing the computer to execute the read program code but also by allowing an OS (Operating System) or the like operating on the computer to execute a part or all of the actual process on the basis of instructions in the program code. Of course, the present invention includes the case where this process is used to provide the functions of the above-described embodiment.

It is also possible to write the program code read from the storage medium to a memory provided in an expansion board inserted into the computer or in an expansion unit connected to the computer and then to allow a CPU or the like provided in the expansion board or unit to execute a part or all of the actual process on the basis of instructions in the program code. Of course, the present invention includes the case where this process is used to provide the functions of the above-described embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-053857, filed Mar. 5, 2007, which is hereby incorporated by reference herein in its entirety.

What is claimed is:

1. An ink jet printing apparatus using a print head capable of ejecting ink through an ejection port formed on an ejection port surface to form an image on a print medium, the ink jet printing apparatus having a cleaning unit capable of performing a cleaning operation for removing a substance hindering ejection of the ink, at a preset cleaning timing, the apparatus comprising:

a cleaning timing storage unit that stores the cleaning timing;

an instructing unit that instructs the cleaning unit to perform the cleaning operation when the cleaning timing comes;

a first storage unit that stores an accumulated dot count that is an accumulated number obtained by predicting and accumulating a number of times that the print head ejects ink between an end of the last cleaning operation and an end of the current consecutive printing operation;

a first determining unit that determines whether or not the cleaning timing set on the basis of the accumulated dot count comes during the current consecutive printing operation; and a control unit that controls the instructing unit such that, when the first determining unit determines that the cleaning timing comes during the current consecutive printing operation, the cleaning operation is not performed during the current consecutive printing operation but performed before a start of the current consecutive printing operation or after the end of the current consecutive printing operation.

2. The ink jet printing apparatus according to claim 1, further comprising:

a second storage unit that stores an accumulated exposure time that is an accumulated time obtained by predicting and accumulating time for which the ejection port surface of the print head is exposed to an exterior between the end of the last cleaning operation and the end of the current consecutive printing operation; and a second determining unit that determines whether or not the cleaning timing set on the basis of the accumulated exposure time comes during the current consecutive printing operation, wherein when at least one of the first and second determining units determines that the cleaning timing comes during the current consecutive printing operation, the control unit controls the instructing unit such that the cleaning operation is not performed during the current consecutive printing operation but performed before the start of the current consecutive printing operation or after the end of the current consecutive printing operation.

3. An ink jet printing apparatus comprising:

a print head capable of ejecting ink through an ejection port formed on an ejection port surface to print an image;

a capping unit that caps the ejection port surface;

a control unit that is capable of performing a first cleaning operation for recovering an ink ejection condition of the print head and a second cleaning operation for recovering the ink ejection condition of the print head by a recovery force greater than that of the first cleaning operation;

a first count unit that accumulates an exposure time passed since the first cleaning operation or the second cleaning operation is ended, wherein during the exposure time, the ejection port surface of the print head is not capped by the capping unit, such that the ejection port surface is exposed to an exterior;

a second count unit that accumulates the number of dots ejected from the print head since the second cleaning operation is ended; and a predicting unit that predicts the exposure time in a next printing operation, wherein in a case that a performing timing of the first cleaning operation comes during the next printing operation, the control unit performs the first cleaning operation and resets the first count unit before the next printing operation is performed, the performing timing of the first cleaning operation being set on the basis of a total exposure time and a basic time for performing the first cleaning operation, the total exposure time being the sum of the exposure time accumulated by the first count unit and the exposure time predicted by the predicting unit, wherein in a case that a performing timing of the second cleaning operation comes during the next printing operation, the control unit performs the second cleaning operation and resets the first count unit and the second count unit before the next printing operation is performed, the performing timing of the second cleaning operation being set on the basis of a total number of dots and a basic number of dots for the second cleaning operation, the total number of dots being the sum of the number of dots accumulated by the second count unit and the number of dots to be ejected in the next printing operation.

* * * * *